US009109399B2

(12) United States Patent
Murr et al.

(10) Patent No.: US 9,109,399 B2
(45) Date of Patent: Aug. 18, 2015

(54) DRILLING STATION

(75) Inventors: Hans-Peter Murr, Offenberg (DE); Georg Streicher, Lalling (DE); Andreas Beck, Bogen (DE); Rupert Koeckeis, Schoenberg (DE); Christian Kersehl, Deggendorf (DE)

(73) Assignee: Max Streicher GmbH & Co. KG AA, Deggendorf (DE)

( * ) Notice: Subject to any disclaimer, the term of this patent is extended or adjusted under 35 U.S.C. 154(b) by 1068 days.

(21) Appl. No.: 13/059,943

(22) PCT Filed: Aug. 10, 2009

(86) PCT No.: PCT/DE2009/001123

§ 371 (c)(1),
(2), (4) Date: Jun. 16, 2011

(87) PCT Pub. No.: WO2010/020214

PCT Pub. Date: Feb. 25, 2010

(65) Prior Publication Data

US 2011/0240371 A1 Oct. 6, 2011

(30) Foreign Application Priority Data

Aug. 20, 2008 (DE) ..... 10 2008 038 456

(51) Int. Cl.

| | |
|---|---|
| ***E21B 7/02*** | (2006.01) |
| ***E21B 15/00*** | (2006.01) |
| ***E21B 19/00*** | (2006.01) |

(52) U.S. Cl.

CPC . *E21B 7/02* (2013.01); *E21B 15/00* (2013.01); *E21B 15/003* (2013.01); *E21B 19/00* (2013.01)

(58) Field of Classification Search

CPC ..... E21B 15/00; E21B 19/24; E21B 19/08; E21B 19/16; E21B 7/02; E21B 7/025; E21B 7/20; E21B 19/00; E21B 3/02; E21B 15/003

USPC ..... 175/162, 203, 220

See application file for complete search history.

(56) References Cited

U.S. PATENT DOCUMENTS

| | | | | |
|---|---|---|---|---|
| 4,899,832 | A | 2/1990 | Bierscheid, Jr. | |
| 5,492,436 | A | 2/1996 | Suksumake | |
| 6,745,852 | B2 * | 6/2004 | Kadaster et al. | 175/5 |
| 6,932,553 | B1 | 8/2005 | Roodenburg et al. | |
| 2003/0102166 | A1 | 6/2003 | Jortveit | |

FOREIGN PATENT DOCUMENTS

| | | |
|---|---|---|
| DE | 202004001242 | 5/2004 |
| DE | 202004001258 | 5/2004 |

(Continued)

OTHER PUBLICATIONS http://www.glossary.oilfield.slb.com/en/Terms.aspx?LookIn=term%20name&filter=top+drive.*

*Primary Examiner* — Shane Bomar
*Assistant Examiner* — Wei Wang
(74) *Attorney, Agent, or Firm* — Boyle Fredrickson S.C.

(57) ABSTRACT

In accordance with the invention, a drilling station or drilling rig, respectively, is provided for use on a drilling platform with a drilling mast, characterized in that the drilling mast and/or the energy supply and/or the generating device for hydraulic energy is/are composed of individual elements, the respective masses of which do not exceed a mass limit value of less than or equal to 25 t. A joining process requiring no welding, preferably by means of quick connectors, is preferred.

19 Claims, 13 Drawing Sheets

(56) References Cited

FOREIGN PATENT DOCUMENTS

| | | |
|---|---|---|
| FR | 2822890 | 10/2002 |
| WO | 0149966 | 7/2001 |
| WO | 2005073471 | 8/2005 |
| WO | 2005073495 | 8/2005 |
| WO | 2008012482 | 1/2008 |

* cited by examiner

DRILLING STATION

BACKGROUND OF THE INVENTION

1. Field of the Invention

The present invention relates to a drilling station or drilling rig or drilling device, respectively, in particular a deep drilling device used in the offshore region, wherein the use of this deep drilling device is preferably performed during vertical drilling for the exploitation of deposits. The term "deposit" comprises in particular the existence of a substance in liquid, gaseous, or solid form, or the presence of energetically utilizable conditions in geological structures, in particular with respect to crude oil, natural gas, and geothermal energy.

2. Description of the Related Art

Vertical drilling is used for the exploitation of oil and gas fields, but also for the production of geothermal energy. From the state of the art, a vertical drilling rig of the type VDD 370 by Max Streicher GmbH & Co. KG aA is known, which is illustrated as an example in FIG. 1 and will be described briefly in the following.

The drilling mast 1 is mounted on a pivot bearing 2 so as to be pivotable with respect to the drilling platform 4. This renders it possible to implement an easy and safe assembly of the drilling mast 1. A vertically movable feed carriage 6 comprising a receiving device 8 for drilling rods is fastened to the drilling mast 1. The drilling rods 10 are supplied via a pipe handler 12 and fixed to the receiving device 8 and subsequently introduced into the well bore. The drilling platform 4 is positioned on a substructure 14 comprising a plurality of segments 16 which are stacked side by side and on top of each other.

Such a rig is described in PCT applications PCT/EP2005/000452, PCT/EP2005/000453, PCT/EP2005/000454, and PCT/EP2005/000455. A use of this drilling rig is also possible in the offshore region. In so doing, the drilling rig is either transported to the drilling site in the assembled state, or is assembled at least partially during towage.

While the offshore drilling rig mentioned is provided for being newly constructed at a site, in today's offshore exploitation of oil and gas fields there exist increasing problems in that the drilling rigs of existing platforms are technically obsolete and frequently can no longer be taken into operation, but the exploitation is desired by making use of existing well bores.

The disassembly of existing drilling rigs and the new construction of drilling rigs is time and cost-intensive, in particular due to the large components of the drilling rig which have to be transported across the sea by means of special vessels, and due to the plurality of joining processes to be performed, in particular welding processes.

SUMMARY OF THE INVENTION

It is an object of the invention to provide a drilling rig or individual functional elements thereof, respectively, by means of which a quick transport and a quick assembly and disassembly is possible, and which complies/comply with the strict safety provisions for offshore drilling rigs, for instance, with respect to the Norsok standard.

The stated object is solved by a drilling rig, an energy supply device, flushing pumps, and a device for generating hydraulic energy.

A drilling rig for use on a drilling platform with a drilling mast is provided. This drilling rig is characterized in that the drilling mast and/or the energy supply and/or the generating device for hydraulic energy is/are composed of individual elements, the respective masses of which do not exceed a mass limit value of less than 25 tons. This enables a quick assembly and disassembly of the drilling rig according to the invention. A rig of drilling mast and substructure may, for instance, be assembled or disassembled within two or three days. In the following, preferably those elements are referred to as individual elements which are adapted to be mounted additionally, for instance, on an existing drilling platform and which are adapted to be joined without welding, preferably in a positive-locking or friction-locking manner, more preferred by a quick connector system such as, for instance, a semi automated twist lock, so as to implement the necessary function. With the drilling rig, preferably rod arrangements are introduced into a well bore, wherein the drilling with individual drilling rods is preferred. Likewise it is possible to produce a bore with the drilling rig according to the invention and to introduce a rod arrangement, or to introduce a rod arrangement into an existing bore. The invention may, however, be used with arbitrary drilling methods. The drilling platform is preferably an offshore drilling platform which may, for instance, be supported on the bottom of the sea or be floatable. Moreover, the drilling mast may be mounted on a substructure, or an additional between-deck may be provided below the drilling mast. In the space below the drilling mast, the blow out preventer will then be provided.

The drilling rig may comprise a substructure on which the drilling mast is mounted and which is adapted to be displaced jointly with the drilling mast on the drilling platform in at least one direction. Thus, increased mobility of the drilling mast may be implemented so as to adapt it to well bores that are to be produced or that are existing. Moreover, the drilling mast may be provided with a feed carriage at which preferably a rotary drive is provided and which is adapted to be driven by a hydraulic and/or electrical drive, and which is adapted to be displaced jointly with the substructure and the drilling mast. Due to this, a compact unit may be implemented in which functional elements for performing the drilling process are provided close to the drilling mast.

A hydraulic supply device via which, for instance, a feed carriage and/or a drilling rod handler may be fed, may be adapted to be displaced jointly with the drilling mast. Due to this, a loss of energy may be reduced and the entire drilling rig may be implemented in a compact manner.

Furthermore, a receiving device for drilling rods and/or other drilling equipment may be adapted to be displaced jointly with the drilling mast. Thus, the travels for introducing the rod arrangement into the well bore are reduced and energy may be saved.

In accordance with an advantageous embodiment the hook load at the feed carriage is at least 200 short tons, preferably approximately 400 short tons. "Short ton" is the measuring unit abbreviated as tn.sh., wherein one tn.sh. corresponds to 907,1874 kilogram. Thus, a high hook load may be implemented with a compact design of the drilling rig, and yet a good maneuverability of the drilling rig may be ensured.

The substructure preferably has a base area of greater than or equal to 6 m×6 m and smaller than or equal to 12 m×12 m. A substructure with such a base area is easy to move and may also be moved in a framework in one direction while the framework is adapted to be displaced in a direction perpendicular to this first direction of movement. Due to this, the drilling rig may also be used with well bores that are positioned close to hindrances.

Moreover, a drilling rig handler may be provided with the instant invention which is adapted to be displaced jointly with the drilling mast. Irrespective of the position of the drilling mast it is thus possible to introduce the drilling rod into the well bore or to remove it from the well bore, respectively, by means of the drilling rod handler.

In the case of the drilling rig according to the invention it is preferred that the drilling rig comprises, stationary with respect to the drilling platform, at least one generator and one electrical device for supplying energy. This energy may be provided both for electrical devices and for hydraulic devices, such as flushing pumps. Due to this, the energy generation may be provided separately from the drilling mast that may also be designed to be displaced, and hence the energy effort for displacing may be reduced and a safe energy generation may be implemented in a stationary arrangement.

Moreover, it may be preferred that the stationary and/or the mobile components of the drilling rig are at least partially, preferably completely, composed of individual elements, the respective masses of which do not exceed the mass limit value indicated. Thus, the drilling rig may be assembled within short time with existing crane equipment on platforms. For instance, the assembly and the bringing into service of the entire rig are, for instance, possible within seven or ten days. In the case of previous rigs with substantially larger modules, for instance, a substantially heavier, massive drilling mast, such short assembly and disassembly times have not been feasible. The individual elements may preferably be joined without welding so as to also comply with the explosion protection on the drilling platform. The positive-locking or friction-locking joining mentioned above is to prefer. The mass limit value is preferably 22 tons, more preferred 17 tons or 15 tons, and most preferred 11 tons. These values enable the inventors to implement the afore-mentioned short assembly or disassembly times for the drilling rig. This value is also influenced by the lifting force of the cranes available on the platform, wherein with the values mentioned the use of the drilling rig according to the invention is possible on a plurality of drilling platforms.

The drilling mast may be adapted to be displaced on a framework in a first direction, and the framework may be adapted to be displaced on the drilling platform in a second direction running substantially at right angles with the first direction. Thus, a bisection into drilling mast and supply facilities is possible, and a quick displaceability of the drilling mast may be implemented.

Preferably, the drilling mast is adapted to be displaced on the framework in the first direction without hydraulic supply device and in the second direction jointly with the hydraulic supply device. Thus, the energy effort for displacing in the first direction can be minimized, and a quick displacement of the drilling mast in the first direction can be implemented. In the drilling rig according to the invention, the hydraulic supply device may, with respect to the second direction, alternatively be arranged at opposite sides of the drilling mast. Thus, concrete situations of the drilling platform may be reacted to, and well bores close to hindrances may also be serviced, and simultaneously a joint displacement of a hydraulic supply device with the drilling mast may be implemented. Such a flexible arrangement enables short operating times of the drilling rig on the drilling platforms. In combination with the short assembly or disassembly times it is possible to implement short-time operations.

The substructure may have the height of at least 2, preferably 3 standard intermodal containers, (e.g., sizes recognized by the International Organization for Standardization), so that standard measurements may also be implemented when constructing the substructure.

The use of the drilling rig according to the invention with an offshore drilling platform is of particular advantage since the transport of individual elements to such a drilling platform is also influenced by weather conditions, the transport capacity of vessels, and the load-bearing capacity of cranes either on the transport vessels or on the drilling platform. Standard measurements and the weight restriction that is, in accordance with the invention, preferably applied to a plurality of individual elements, also enable the transport and the loading or unloading of transport vessels in the case of unfavorable weather conditions.

The functional elements for controlling, supplying, and operating a drilling device and/or the periphery are designed at least partially redundantly. Thus, it is possible to operate the drilling rig even in the case of failure of individual elements, and the abandonment of the well bore due the fact that, for instance, the rod arrangement has got stuck may be prevented. Such an emergency operation need not be performed with full power, but the elements may be adapted such that the operation of a respective functional element allows for a basic supply of the well bore.

The control device for monitoring the drilling process may be designed redundantly, so that monitoring of the drilling process is possible even if an operator fails or a working place is damaged.

In accordance with the invention, there is provided an energy supply device, preferably for a drilling rig, more preferred for an offshore drilling rig, in which a combustion engine and the generator are provided in two modules and the respective masses of the combustion machine and of the generator do not exceed a respective mass limit value of less than or equal to 25 tons, preferably 11 tons. The separation of combustion engine and generator makes it possible that, for instance, generator performances of e.g. at least 500 kVA can be implemented and yet easy transportation of the individual elements to the offshore drilling platforms is possible.

The modules may be adapted to be joined in a gas-tight manner, so that explosion protection is complied with. The joining of the modules is preferably performed in an air-tight manner. Optionally, a further module in which a heat exchanger and a fuel tank are provided may be provided with the energy supply device, and another module with a security entrance and a control field may also be provided. Alternatively, these modules may also be integrated into the module of the combustion engine and/or the generator. Such a modular separation enables a strict observance of a mass limit value and a full functionality with high performance on drilling rigs, preferably offshore drilling rigs.

In accordance with the invention, flushing pumps, preferably for a drilling rig, more preferred for an offshore drilling rig, are further provided for pumping the drilling fluid with at least two, preferably four pumps, the masses of which do not exceed a mass limit value of less than 25 tons, preferably 11 tons. Thus, it is possible to implement a redundant design of the pumps, which enables emergency operation of the rig even in the case of a partial failure. Moreover, easy transportability of the individual elements may be ensured.

In accordance with the invention, a device for generating hydraulic energy for a top drive and/or a handler may additionally be provided, wherein the individual functional elements forming the device are designed redundantly. Due to this, for instance, for a drilling rig, preferably an offshore drilling rig, an emergency operation may be implemented for the operation of the top drive and the handler so as to ensure the operation of the rig in the case of a partial failure of the rig.

Further developments in accordance with the invention are the subject matters of the subclaims.

BRIEF DESCRIPTION OF THE DRAWINGS

In the following, the invention will be described by means of the enclosed drawings, in which.

DESCRIPTION OF THE PREFERRED EMBODIMENT

Figure 1:
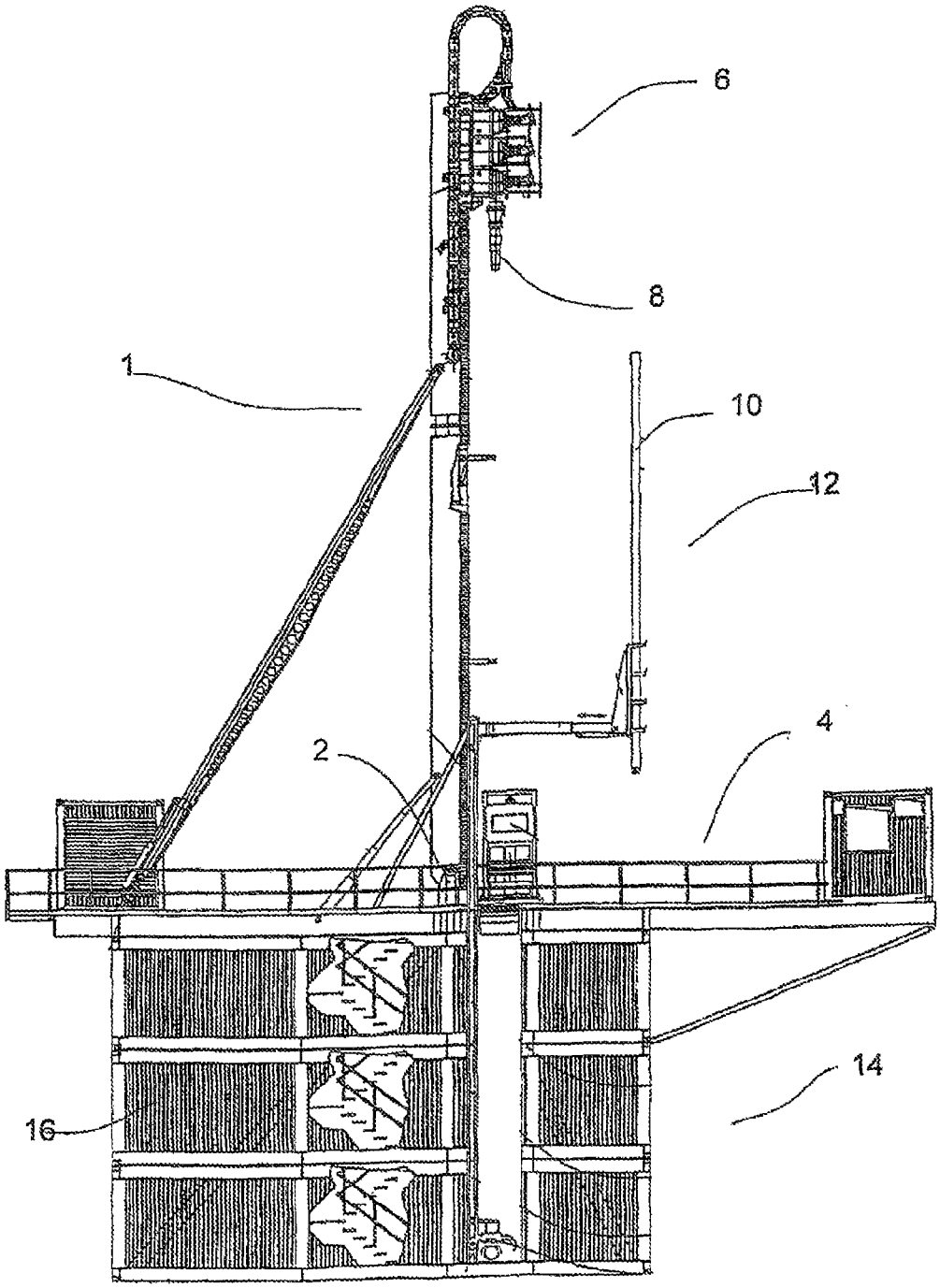
Fig. 1 (Prior Art)
FIG. 1 shows a drilling device according to the state of the art.
Figure 2:
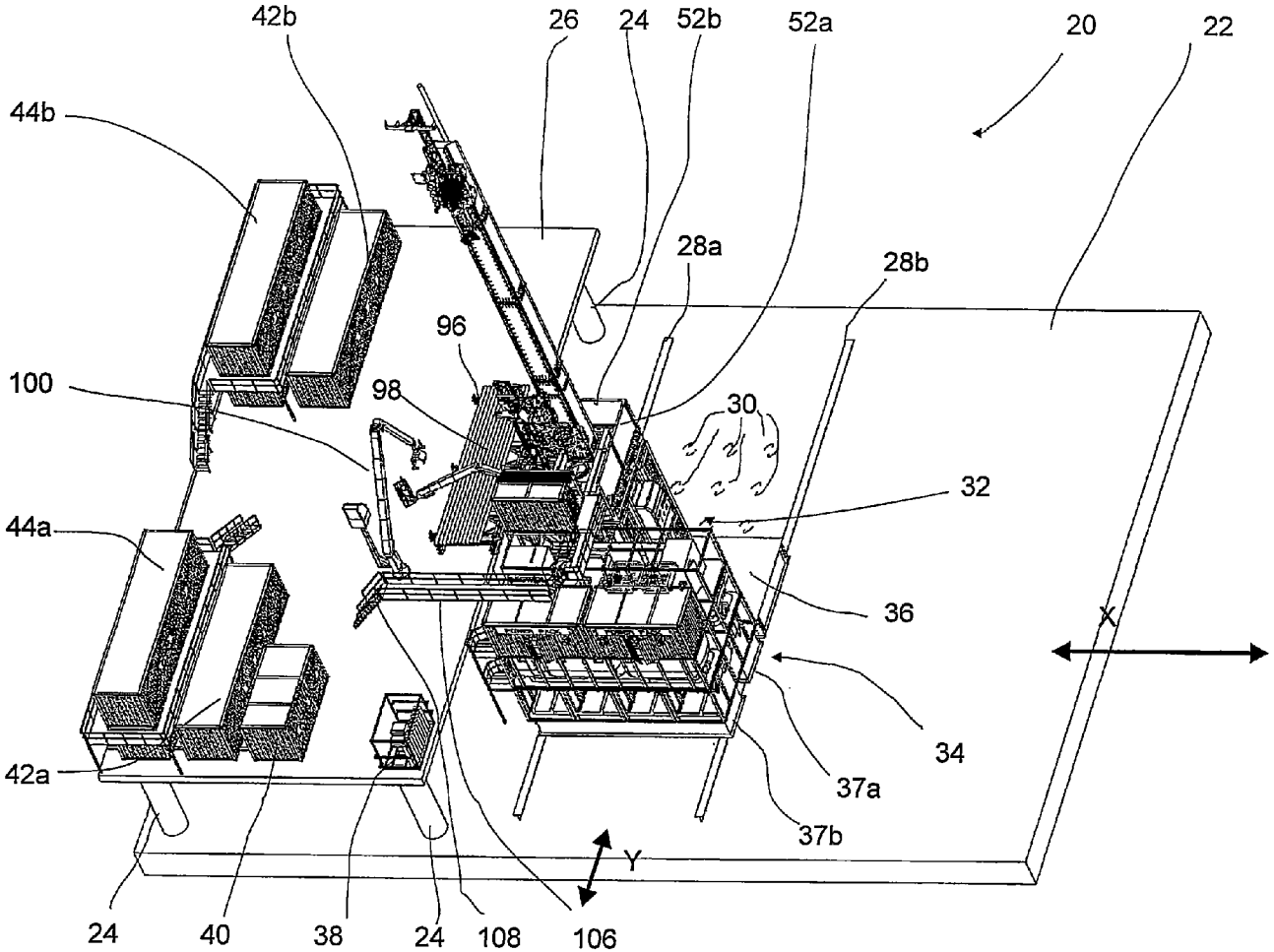
FIG. 2 shows an oblique top view from the left of the drilling rig in accordance with the invention.

An offshore vertical deep drilling rig in accordance with the present invention is illustrated in FIG. 2 in an oblique view from the left.

The offshore vertical deep drilling rig 20 is positioned on a substructure, e.g. on a drilling platform 22 which, as is illustrated in FIG. 2, may have a drilling platform section 26 that is, for instance, elevated by means of supports 24. The drilling platform 22 comprises a longitudinal direction X and a transverse direction Y. In parallel to the arrangement of the well bores, preferably 2 guide rails 28*a* and 28*b* are positioned. The drilling unit 32 and the hydraulic and preparation unit 34 are positioned on the guide rails 28*a*, 28*b*. The units 32 and 34 are designed to be displaced on the guide rails 28*a*, 28*b* in transverse direction Y.

The drilling module 32 is mounted on the guide rails 28*a*, 28*b* via a framework 36 on which the drilling module 32 is adapted to be displaced in longitudinal direction X of the drilling platform. Due to this, it is possible to position the drilling unit over a desired well bore 30 by displacement both in X and in Y direction. The hydraulic and preparation unit 34 is mounted on the guide rails 28*a*, 28*b* via framework elements 37*a*, 37*b*.

Figure 5:
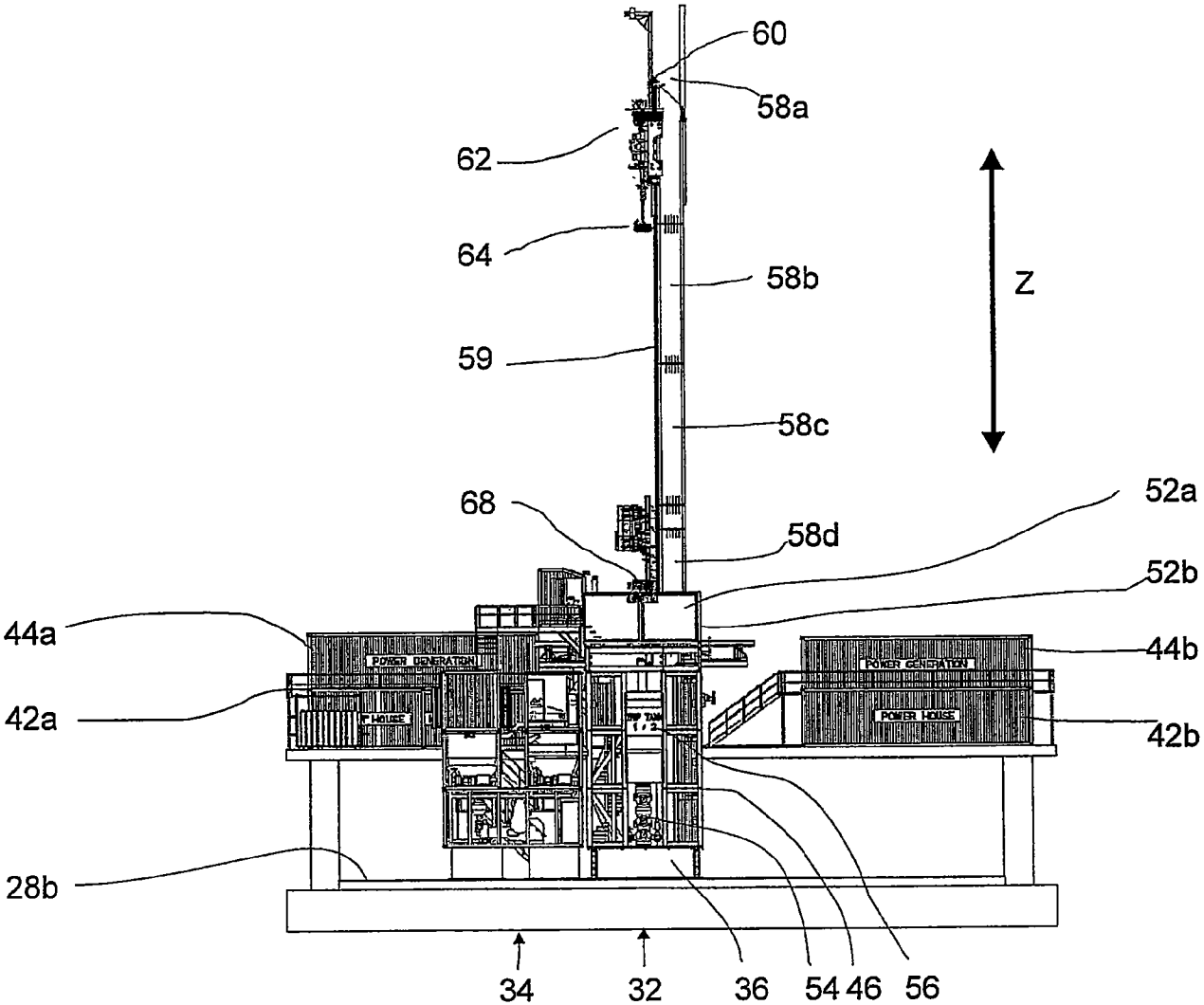
FIG. 5 shows a view from the front of the drilling rig in accordance with the invention.

In order to be able to comply with different positions of the well bores 30, the positions of the drilling unit 32 and of the hydraulic and preparation unit 34 may be exchanged. In FIG. 5, a front view of the drilling unit 32 and of the hydraulic and preparation unit 34 is illustrated in the position shown in FIG. 2. In the case of exchanged units 32 and 34, the drilling unit 32 is, in contrast to FIG. 5, positioned at the left side while the hydraulic and preparation unit 34 is positioned at the right side.

The hydraulic pressure reservoir 38 for the blow out preventer, an electronic control unit 40, electrical energy distribution modules 42*a*, 42, and generators 44*a* and 44*b* belong also to the drilling rig. The drilling unit 32 and the hydraulic and preparation unit 34 are supplied with electrical energy by the electronic control unit 40 and the electrical energy distribution modules 42*a*, 42*b*.

Figure 3:
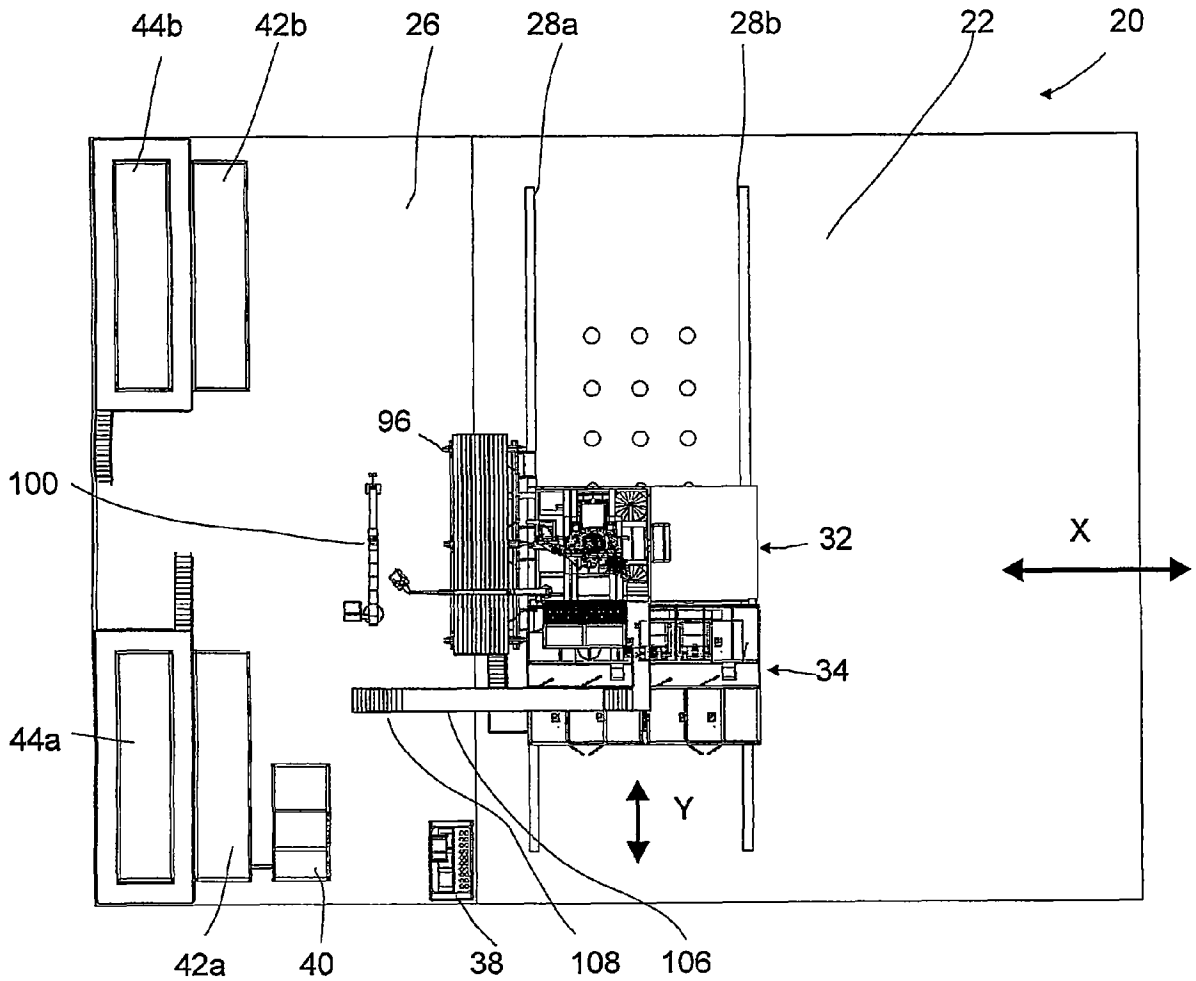
FIG. 3 shows a top view of the drilling rig in accordance with the invention.

FIG. 3 illustrates a top view of the deep drilling rig 20 in accordance with the invention. As may be taken from FIG. 3, as the drilling unit 32 and the hydraulic and preparation unit 34 are moved on the guide rails 28*a*, 28*b* in Y direction, the relative distance to the electrical energy distribution modules 42*a*, 42*b* and the electronic control unit 40 changes. To account for the change of this relative distance, guide chains that are not illustrated are used in the present invention, so that a safe energy supply by the units 40, 42*a*, 42*b* is guaranteed in the case of a different relative position of the units 32 and 34 on the drilling platform 22.

An advantage of the present deep drilling rig consists in that it is of modular construction. In this respect, demands with respect to loads that are to be moved by platform cranes are complied with. The upper limit for all individual elements of which the drilling rig is composed and which have to be transported may, for instance, be 20 t or 17 t, 15 t, 13 t, or preferably 11 t. The observing of the maximum limit for the mass of the individual elements or modules, respectively, makes it possible to load and unload the individual elements for the drilling rig according to the invention with conventional platform cranes. Moreover, mechanical joining devices are preferred for joining the individual elements for the assembly on the drilling platform 22 without welding. The use of conventional transport vessels for transporting the individual elements further makes it possible that the modules may also be transported to the drilling platform in the case of difficult weather conditions and rough sea.

Figure 4:
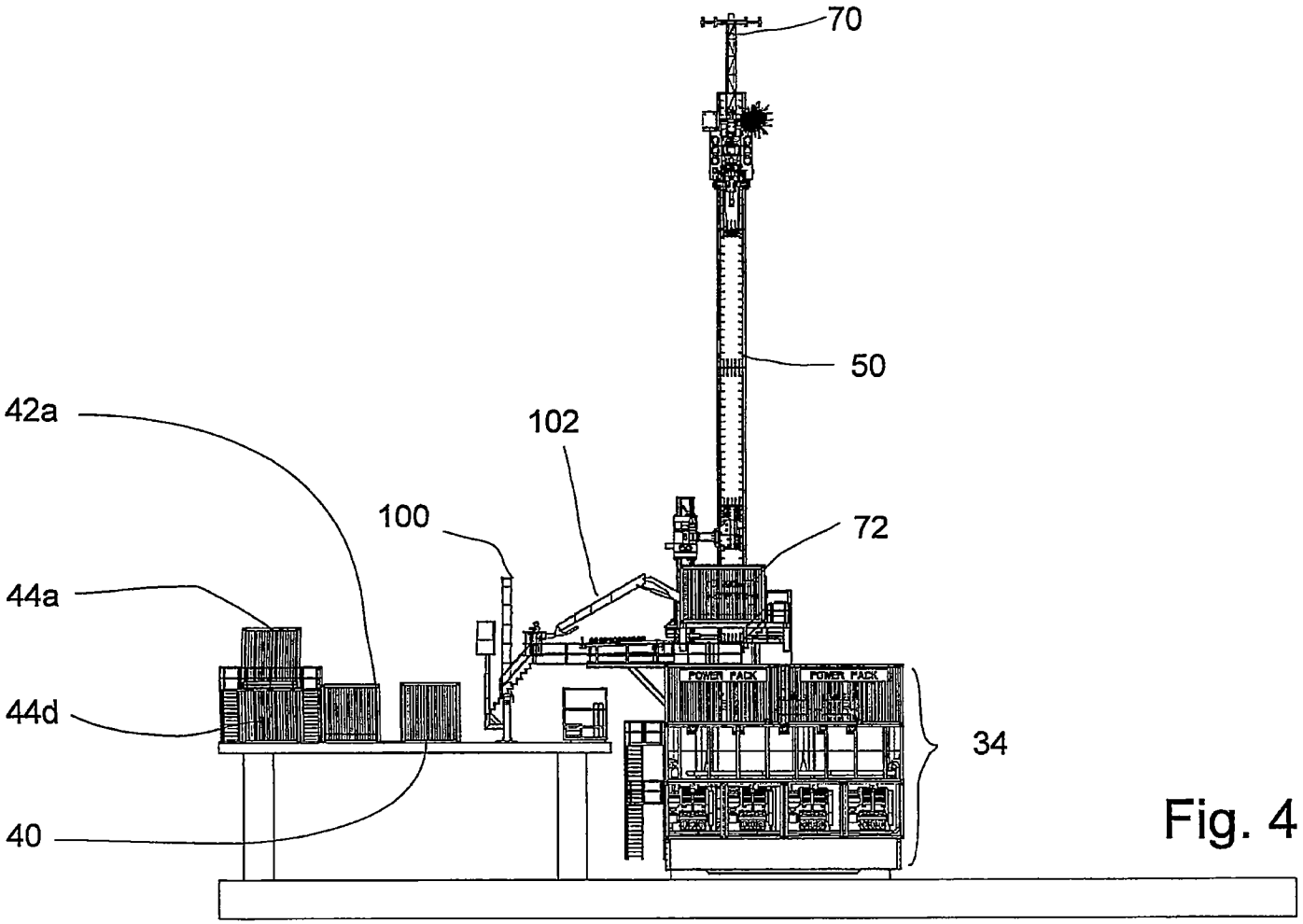
FIG. 4 shows a view from the left of the drilling rig in accordance with the invention.

In the following, the structure of the drilling unit 32 and of the hydraulic and preparation unit 34 will be explained by making reference to the side view from the left illustrated in FIG. 4, the enlarged illustration of the side view from the left illustrated in FIG. 6, the front view illustrated in FIG. 5, and the details from the front view of FIG. 5 illustrated in FIGS. 8 to 10, the top view of FIG. 3, and the details of this top view of FIG. 3 illustrated in FIG. 7, as well as by making reference to the detailed views of FIG. 11.

The complete view of the drilling unit 32 may be taken from FIG. 5. On the framework 36 it comprises a substructure 46 on which the working platform 48 that may be taken from FIG. 10 is positioned. Above the working platform 48, the drilling mast 50 extends substantially perpendicularly thereof. Directly above the working platform 48, windbreak elements 52*a*, 52*b* are provided.

Figure 13:
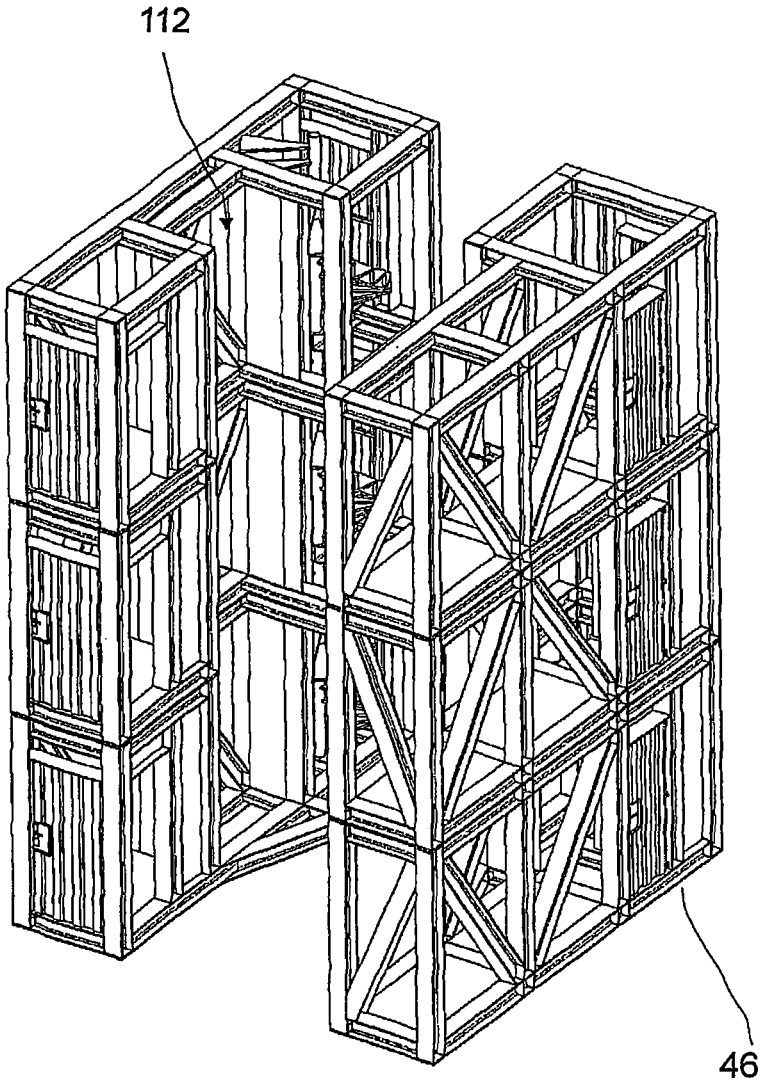
FIG. 13 shows a perspective top view of the substructure from the rear left.

The substructure 46 comprises, as may also be taken from the view from the rear left in FIG. 13, in the present embodiment 3 levels connected with each other via spiral stairs. The blow out preventer 54 is positioned in the substructure 46. The trip tank 56 is provided above the blow out preventer 54. The present invention is, however, not restricted to the provision of the substructure with 3 levels and the provision of spiral stairs for connecting the levels, but any number of levels adapted to the drilling demands and comprising, for instance, a ladder structure between the levels, may also be provided.

In the embodiment illustrated in FIG. 5, the drilling mast 50 comprises four individual segments 58*a-d* which are mechanically joined with one another. The inventors have found out that this partitioning of the drilling mast 50 into segments is of advantage for a construction on offshore platforms. Details with respect to the assembly method of the drilling mast will be explained in detail further below.

Figure 8:
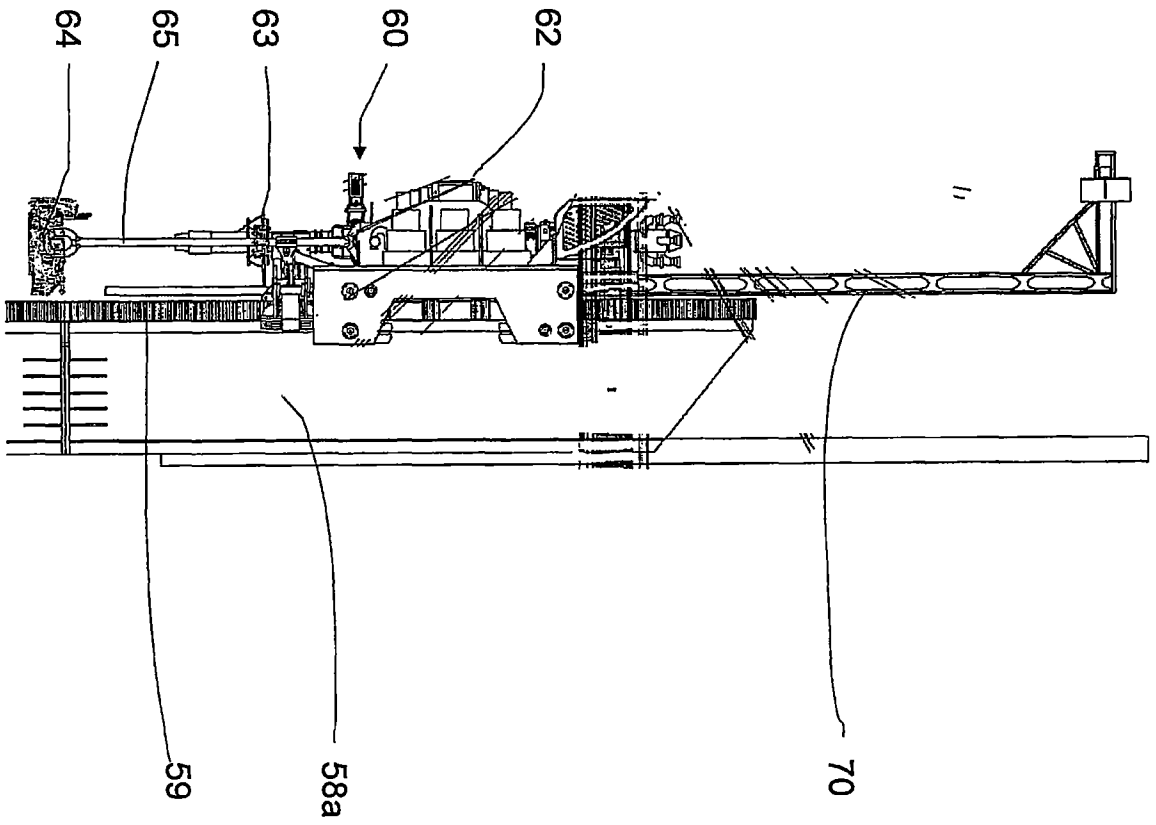
FIG. 8 shows a view of the top mast end with top drive and guidance for the cable carriers of the drilling rig in accordance with the invention.

At the drilling mast 50, in the longitudinal direction Z thereof, gear rods 59 and guide rails are positioned on which a feed carriage 60 that is illustrated in more detail in FIG. 8 is adapted to be displaced in the longitudinal direction Z. In so doing, at least one toothed wheel at the feed carriage 60 is driven by at least one feed motor. Furthermore, holding brakes are formed at the feed carrier via which it is possible to position the feed carriage 60 in a stationary manner at the drilling mast 50. The feed carriage 60 further comprises a drilling motor 62 with a receiving device 63 for mounting the drilling rods as well as a rod shaft 65 with an elevator 64 mounted thereon. This rod shaft 65 serves for the quick removal of the rod arrangement from the well bore and the new introduction thereof down to the depth that has already been drilled. During the drilling process in which the torque of the drilling motor 62 is, via the receiving device 63, applied to the drilling head in the well bore, the rod shaft 65 with the elevator 64 is pivoted away.

The lines for supplying the drilling motor 62 and the feed carriage 60 are fastened to a guide element 70 that extends, if the feed carrier 60 is positioned at the top of the drilling mast 50, beyond the top segment 58*a* of the drilling mast. As may be taken from the view from the left illustrated in FIG. 4, the guide element 70 comprises a segment with a longitudinal extension in the longitudinal direction X, so that it is possible to keep a plurality of hydraulic lines for the drilling motor 62 side by side with a small mutual influencing only.

Figure 9:
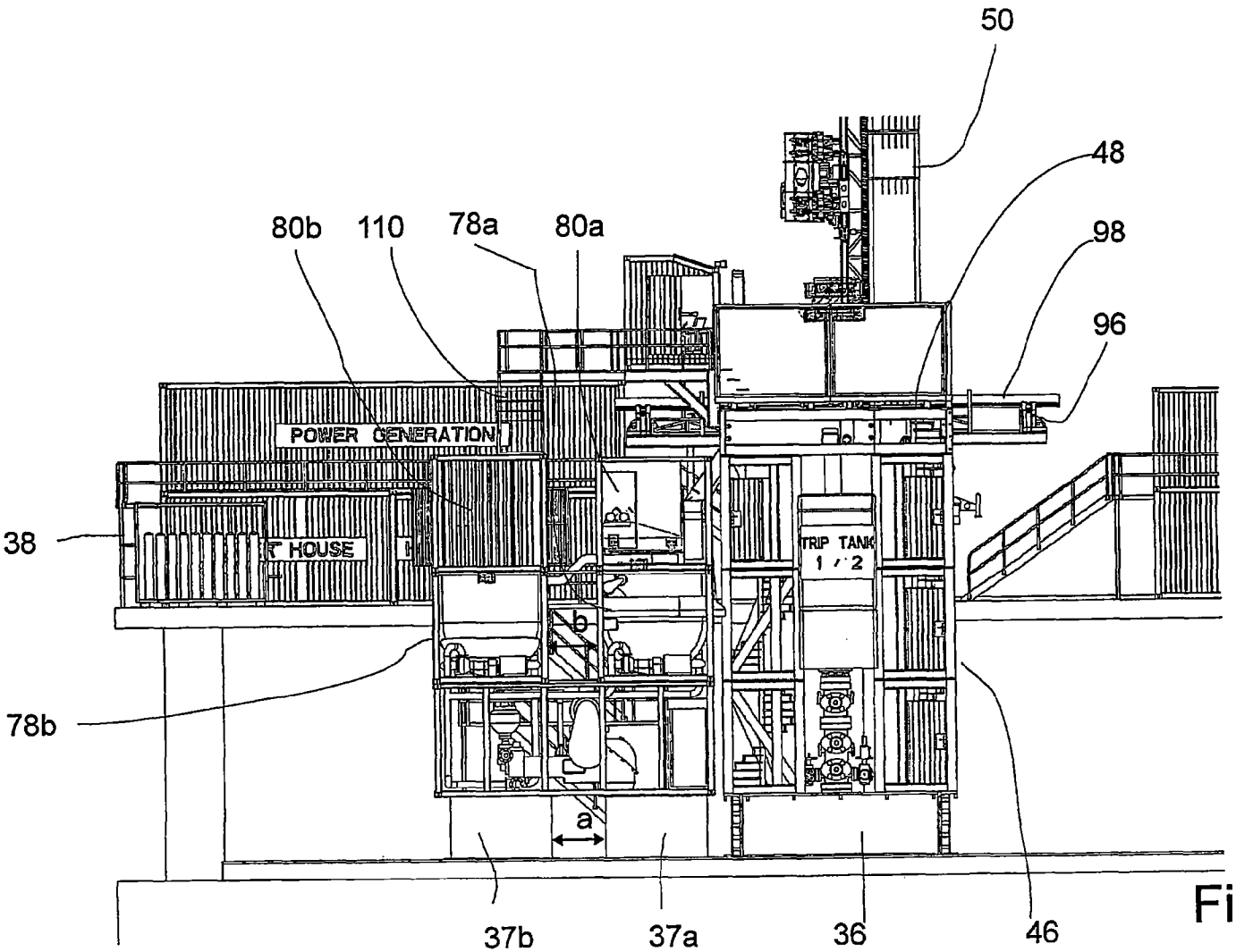
FIG. 9 shows a section of the front view of the drilling rig in accordance with the invention.
Figure 10:
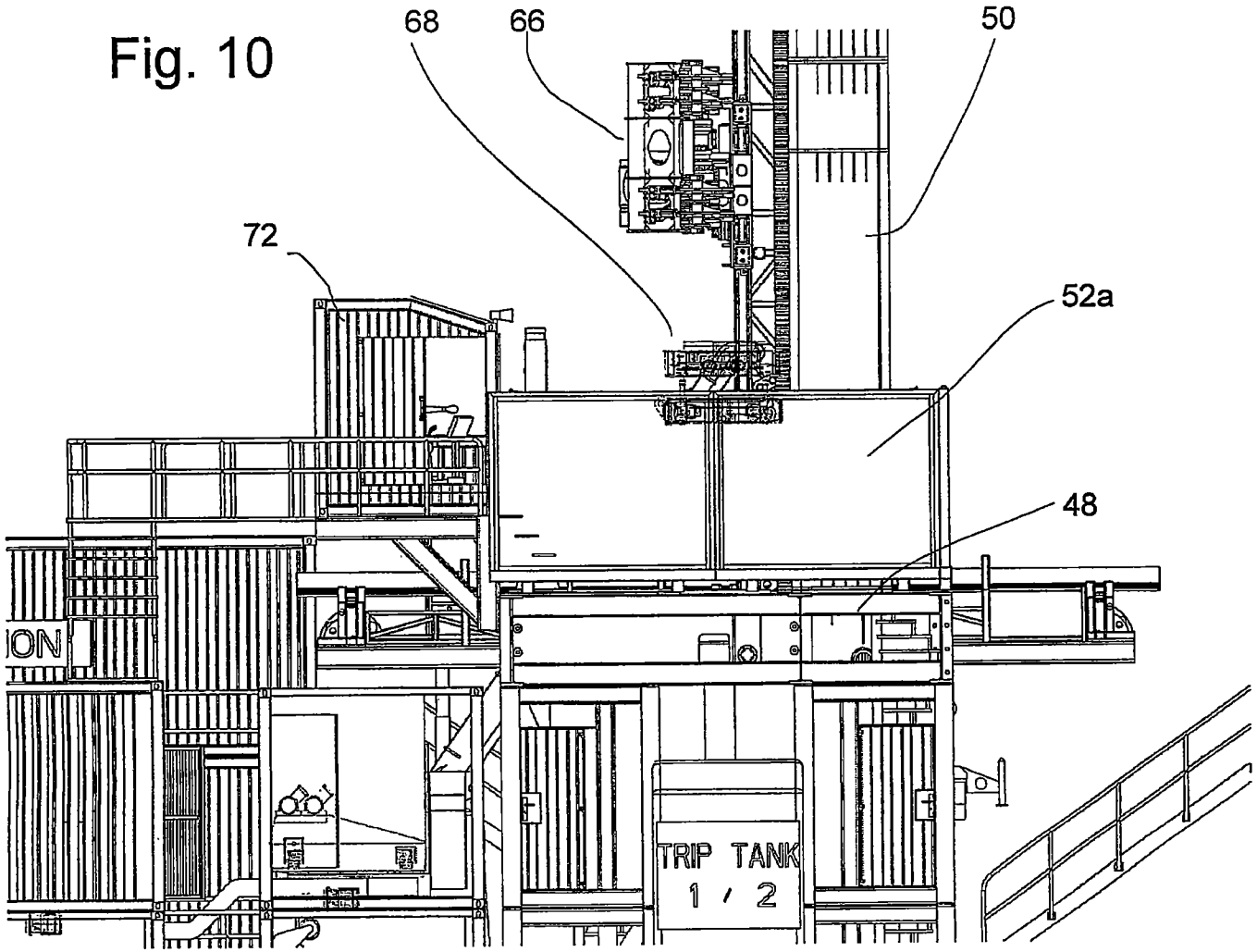
FIG. 10 shows an enlarged view of the section of the front view of the drilling rig in accordance with the invention.

As may be taken from FIGS. 9 and 10, a drilling rod handler 66 and a screwing device 68 are provided at the drilling mast 50 adjacent to the working platform 48. A wedge that is not illustrated is fastened to the working platform 48 by which it is possible to hold the drilling rods that have already been introduced into the well bore during screwing. For applying another drilling rod, it is positioned by the drilling rod handler 66 perpendicularly above the drilling rod introduced into the well bore and is screwed by means of the screwing device 68. The screwed drilling rods are then driven by the drilling motor 62 at the feed carriage 60, so that the drilling rod applied by the drilling rod handler 66 is adapted to be introduced into the well bore. The use of the drilling rod handler 66 will be explained in more detail further below.

The applying of the drilling rods is monitored via a control cabin 72 provided adjacent to the working platform 48. The control cabin 72 preferably comprises two workplaces through which the same operating tasks may be implemented. This redundancy refers to a second advantage of the invention, namely that preferably at least central devices are provided redundantly with the offshore vertical deep drilling rig 20 according to the invention, so that, if one device fails, the operation of the deep drilling rig may be maintained by the second device having an identical basic function. Due to this, a high technical overall availability of the drilling rig is achieved, which is of advantage in particular for offshore rigs where necessary repair always entails great efforts of time and costs.

Now, the hydraulic and preparation unit 34 will be explained in more detail also with respect to the drilling unit 32.

Figure 11C:
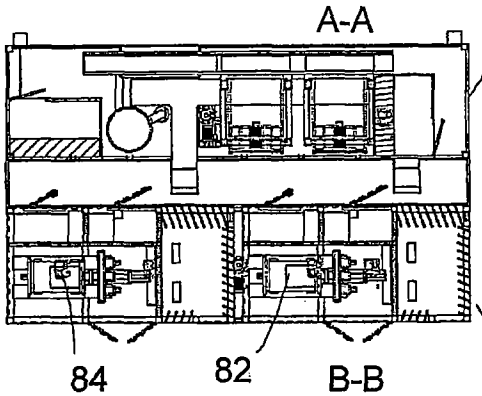
FIG. 11A shows a view from the left of the drilling fluid preparation and the hydraulic aggregates, FIG. 11B a top view of the drilling fluid preparation and the hydraulic aggregates, FIG. 11C a sectional view at the line A-A of FIG. 11A, FIG. 11D a sectional view at the line B-B of FIG. 11A, and FIG. 11E a sectional view at the line C-C of FIG. 11A.
Figure 11D:
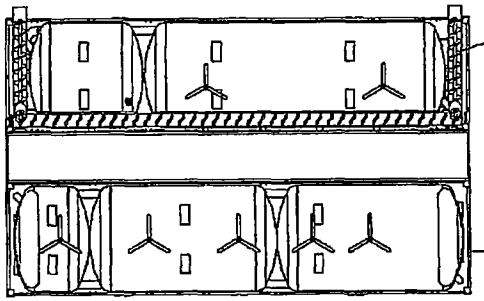
Figure 11E:
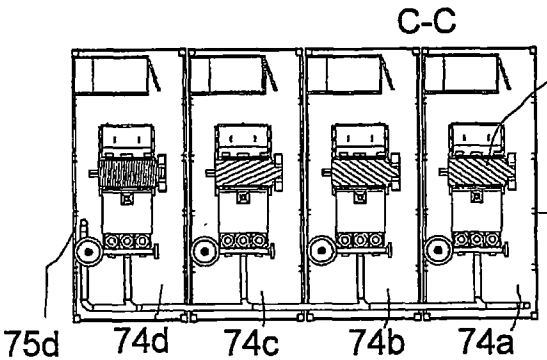
Figure 11A:
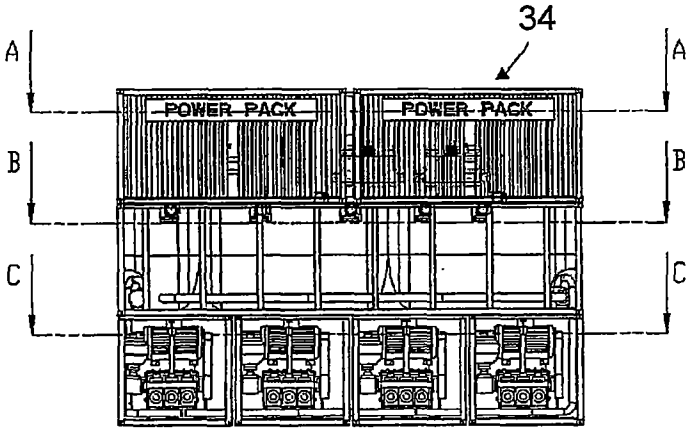
Figure 11B:
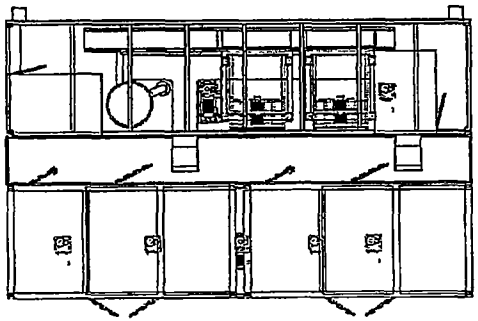

As may be taken from the front view of FIG. 9, the view from the left of FIG. 11A, and the sectional top view of FIG. 11E, four transverse modules 74*a-d* that are arranged in parallel are provided on the two framework elements 37*a*, 37*b* that are positioned side by side at a predetermined distance a, are of substantially rectangular shape, and extend each in the longitudinal direction X of the drilling platform 22. Each of these transverse modules 74*a-d* comprises a respective framework 75*a-d* into which a respective flushing pump 76*a-d* with a gear is inserted.

Conventionally, less than 4 flushing pumps are used with a vertical drilling rig. In the instant case, however, using four flushing pumps has turned out to be advantageous. Due to the mass restriction for the individual elements as suggested by the inventors, each of the frameworks 75*a-d* and each of the flushing pumps 76*a-d* is transported individually. In so doing, the flushing pumps with a gear are preferably selected such that the respective pump mass lies below the mass restriction, for instance, 11 t. By means of the provision of four flushing pumps it is, moreover, possible to implement the inventors' concept of designing the devices of the drilling rig redundantly.

Two longitudinal modules 78*a*, 78*b* accommodating the tanks for the drilling fluid are mounted in longitudinal direction X on the four transverse modules 74*a-d*. A sectional view of the tanks is illustrated in FIG. 11D with the section B-B in FIG. 11A. Here, too, the redundant design of the devices is preferred. Furthermore, the provision of two tanks with different holding capacities in the longitudinal module 78*a* and of three tanks in the longitudinal module 78*b* is an example only, and any tank configuration that is in line with the flushing pumps 78*a-d* may be used in the longitudinal modules. The two longitudinal modules 78*a*, 78*b* are spaced apart from each other by a distance b and may be connected with one another by a bridge. The distance b is caused by safety-technical reflections. On the other hand, a compact hydraulic and preparation unit 34 is to be provided.

Two longitudinal modules 80*a*, 80*b* are positioned on the longitudinal modules 78*a*, 78*b*. As may be taken from the sectional view A-A in FIG. 11C, the filter unit is positioned in the longitudinal module 80*a* while the hydraulic aggregates 82, 84 for the drilling motor 62, more exactly speaking for the rotating and displacing of the receiving device 63 and the feed carriage 60, are provided in the longitudinal module 80*b*.

The afore-described design of the hydraulic and preparation unit 34 is, however, just an example, and any modification with respect to the number and the function of the modules or the individual elements of this unit 34 may exist. From energetic points of view it is indeed favorable to provide the hydraulics for the feed carriage 60 in the uppermost modules. But it may likewise be provided at any place in the unit 34. Moreover, the drilling fluid preparation and/or the flushing pumps and/or the drilling fluid tank and/or the hydraulic supply device may also be provided in a stationary manner on the drilling platform 22.

Figure 6:
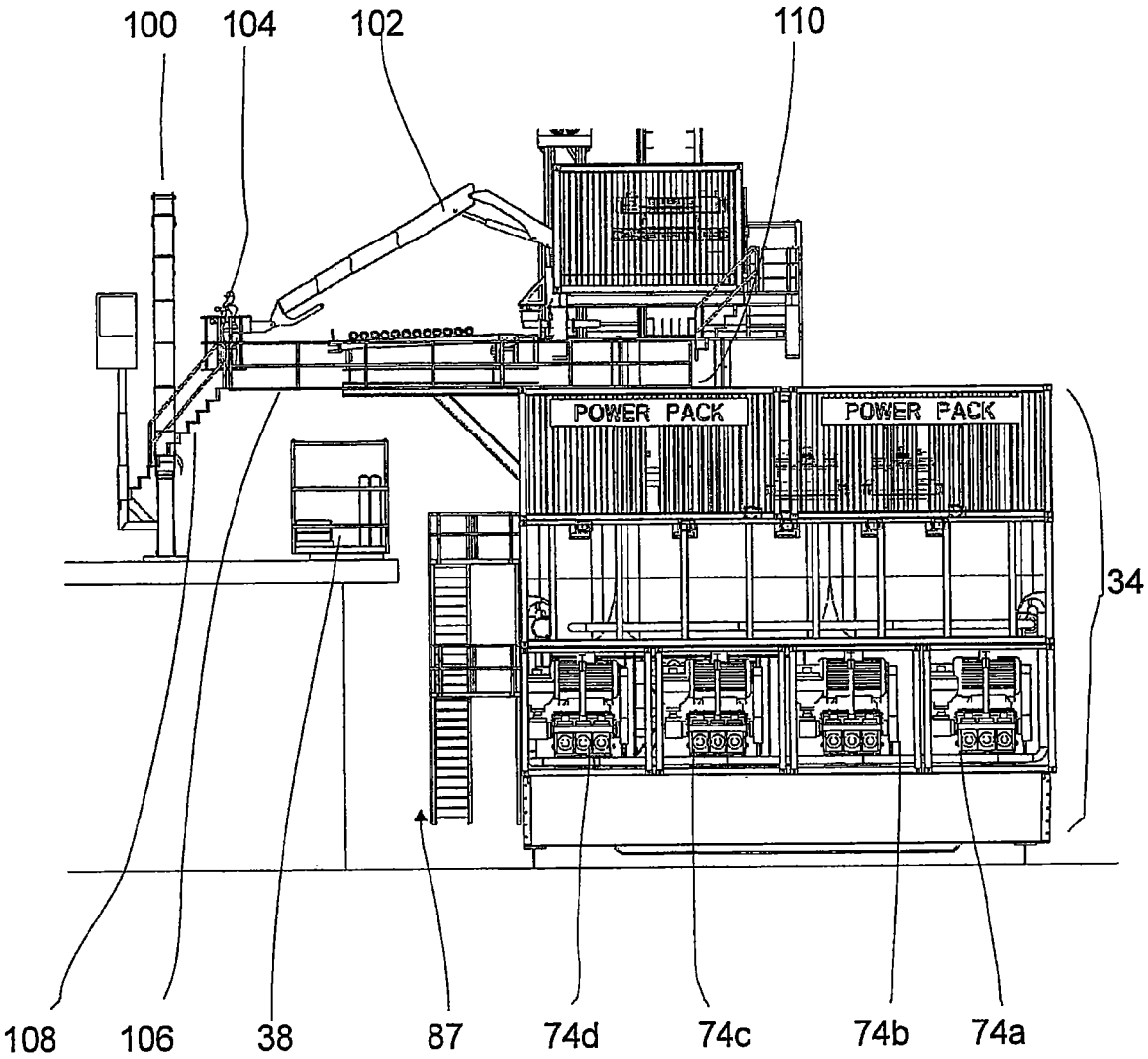
FIG. 6 shows a section of a view from the left of the drilling rig in accordance with the invention.
Figure 7:
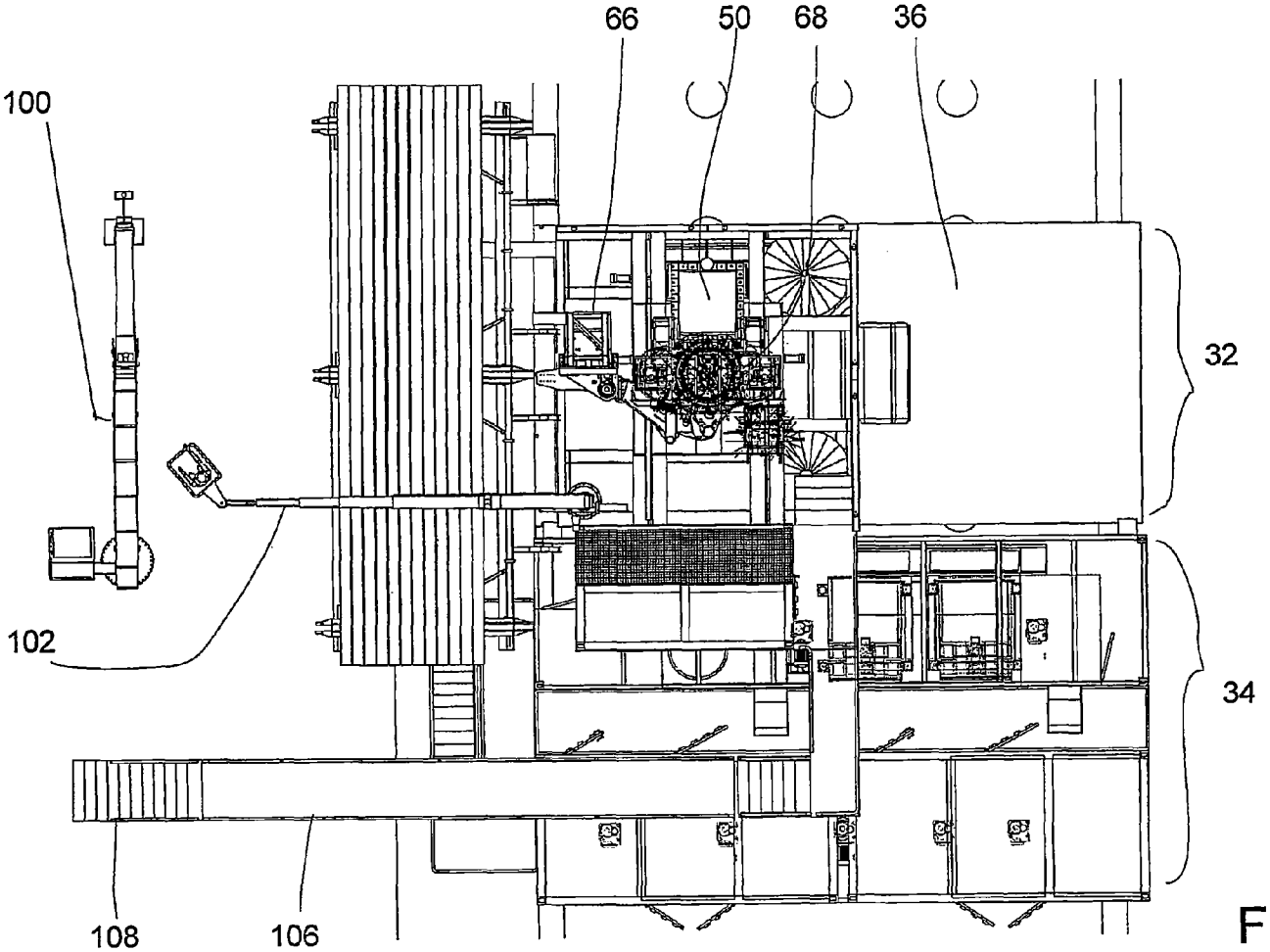
FIG. 7 shows a section of the top view of the drilling rig in accordance with the invention.

In the view from the left in FIG. 6, the bridges 87 through which the transverse modules 74*a-d* and the longitudinal modules 78*a-d* are accessible are illustrated.

The joint provision and the joint moving of the drilling unit 32 and the hydraulic and preparation unit 34 constitutes a difference to conventional stationary onshore deep drilling rigs in which the tanks, the flushing pumps, and the hydraulic aggregates for driving the top drive are at least partially accommodated in the drilling platform 22 in a stationary manner.

The electrical energy distribution modules 42*a, b* and the generators 44*a*, 44*b* supply the hydraulic aggregates in the hydraulic and preparation unit 34 with electrical energy. It is also possible to generate control signals for the hydraulic aggregates in the electronic control unit 40 and to supply them to the unit 34.

Figure 12A:
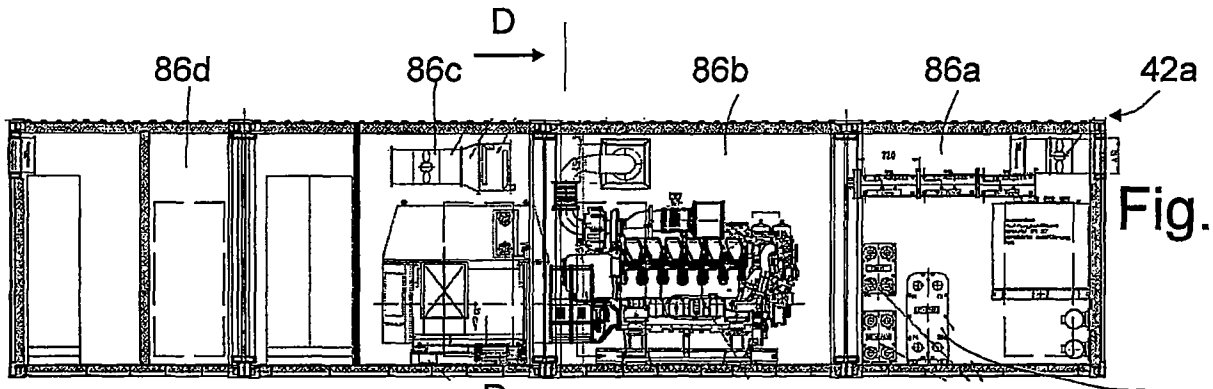
FIG. 12A shows a sectional view through a generator of the drilling rig in accordance with the invention, FIG. 12B a sectional top view of the generators of the drilling rig in accordance with the invention, FIG. 12C a sectional view at the line D-D of the generators, and FIG. 12D a sectional view at the line E-E in FIG. 12B of the generators of the drilling rig in accordance with the invention.
Figure 12B:
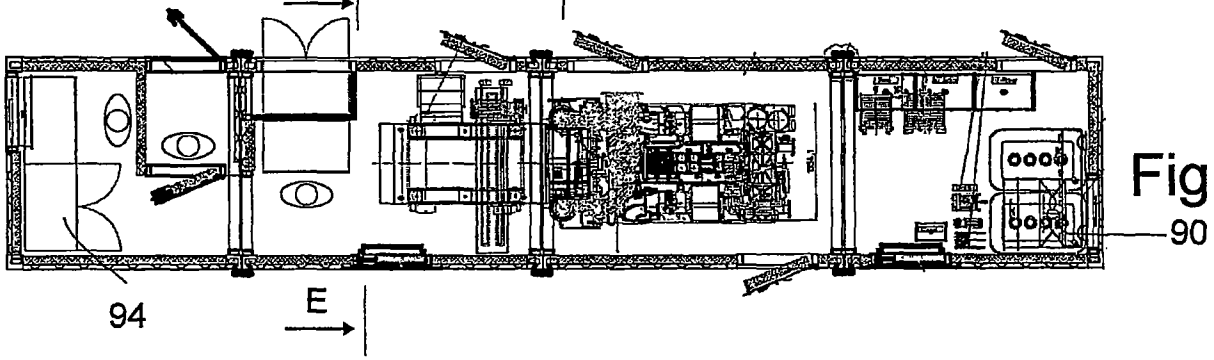
Figure 12C:
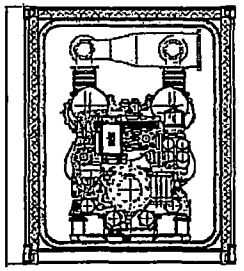
Figure 12D:
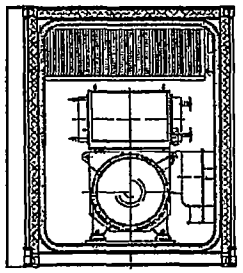

The electrical energy distribution modules 42*a, b*, the generators 44*a*, 44*b*, and the electronic control unit 40 are also constructed in line with the mass restriction for individual elements of the drilling rig. This is shown by way of example by reference to a generator 44*a* in FIGS. 12A to 12D, wherein FIG. 12A constitutes a sectional side view of the generator 44*a*, FIG. 12B a sectional top view, FIG. 12C a sectional view at the line D-D in FIG. 12A, and FIG. 12D a sectional view E-E in FIG. 12B.

Conventionally, the generators for offshore rigs are designed as one-piece modules. In the present invention, the generator module 44*a* was divided into four modules 86*a-d* so as to observe the mass restriction of, for instance, 11 t which was found to be advantageous by the inventors. In the module 86*a*, heat exchangers 88 for the heat transfer of motor, generator, diesel, and residual heat and a fuel tank 90 are provided. The module 86*b* accommodates the drive motor for the generator which is also dimensioned such that it does not exceed the predetermined mass limit of, for instance, 11 t, at least without the framework of the module 86*b*. A drive motor with a performance of more than 1000 kW is preferred.

Since, as may be taken from FIG. 5, four generators 44*a-d* may be used, the minimum performance of the generators will be more than 4000 kW. However, any other performance adapted to the required drilling work may be provided with any number of generators. Also the generators are preferably designed redundantly, so that, in the case of an average, the well bore may be safeguarded at reduced performance.

The generator with a corresponding heat dissipation is accommodated in the module 86*c* while the module 86*d* comprises a security entrance 92 and a control field 94. Due to this modular design, a breakdown into functional blocks with simultaneous safeguarding of a performance of the generator which is adapted to the demands of offshore platforms is performed.

The electrical energy distribution modules 42*a, b*, which are also of modular design with a view to the mass restriction, accommodate electrical units so as to feed the electrical consumers of the drilling rig at corresponding connections. For instance, the frequency converters for the hydraulic pumps in the hydraulic and preparation unit 34 and the circuit breakers may be found there.

The electronic control unit 40 provides the control signals for the drilling process and performs the signal preparation to and from the control cabin 72.

The fuel tanks for supplying the generators are not illustrated in FIG. 2. The fuel, preferably diesel, in the fuel tanks 90 is merely provided as a day's provision. Diesel tanks may, for instance, be provided on the energy generating platform 26 between the drilling unit 32 and the electrical energy distribution module 42*b*.

A drilling rod rack 96, as is shown in FIG. 2, is fastened to the working platform 48 at the side opposite to the windbreak 52*a* and adjacent to the windbreak 52*b* and the control cabin 72. The drilling rods that are to be inserted directly into the well bore are positioned on this drilling rod rack 96. A drilling rod store on which a larger amount of drilling rods than on the drilling rod rack is stored, preferably for a plurality of days, is not illustrated in the drawings.

The transportation of the drilling rods between the—not illustrated—drilling rod store and the drilling rod rack is performed by a crane 100 that is preferably pivotable by 360° and that allows for a filling of the drilling rod rack at different relative positions of the drilling unit 32 on the guide rails 28*a*, 28*b*. The drilling rod handler 66 that has already been explained by reference to FIG. 10 takes up the drilling rods 98 that are positioned horizontally on the drilling rod rack 96, orientates them to be vertical, and screws them by means of the screwing device 68 with the rod arrangement in the well bore which is held by the wedge system with respect to the drilling platform.

Furthermore, an inspection and maintenance crane 102 at which a cage 104 is adapted to be mounted is fastened to the working platform 48. Due to this, it is easy for the maintenance personnel to get to the desired places quickly.

As may further be taken from FIGS. 2 and 6, an access platform 106 with stairs 108 via which the unit 34 is accessible is provided at the hydraulic and preparation unit 34. The access platform 106 is connected via stairs 110 with an access to the control cabin 72. The stairs 108 are preferably arranged such that, if the units 32 and 34 are displaced along the entire length of the guide rails 28*a*, 28*b*, the stairs 108 may move past the crane 100 for the drilling rods. Alternatively, a temporary removal of the crane 100 may also take place so as to displace the units 32, 34. If the use of the deep drilling rig according to the invention is desired in a particular region of the guide rails 28*a*, 28*b* only, the place of installation of the stairs 108 and of the platform 106 may be adapted appropriately.

As may be taken in particular from FIG. 6, the bridges 87 and the access platform 106 with the assigned stairs are, on the one hand, designed such that a movement over the desired extension in transverse direction Y is possible without colliding with units at or on the platform. On the other hand, the arrangement of the stairs ensures that the units 32, 34 are always accessible.

The drilling rig according to the invention thus enables an easy assembly or disassembly while a high productive efficiency can be implemented with little space being required. Since the mass limit value may also be implemented with each of the individual functional elements, the present invention may also be implemented in a modular manner in the form of individual functional elements only.

In accordance with the invention, a drilling rig for use on a drilling platform with a drilling mast is thus provided, characterized in that the drilling mast and/or the energy supply and/or the generating device for hydraulic energy is/are composed of individual elements, the respective masses of which do not exceed a mass limit value of less than or equal to 25 t. A joining process requiring no welding, preferably by means of quick connectors, is preferred.

There is provided a drilling rig for use on a drilling platform with a drilling mast, wherein the drilling rig comprises a substructure on which the drilling mast is mounted and which is adapted to be displaced jointly with the drilling mast at least in one direction on the drilling platform, wherein the drilling mast is adapted to be displaced on a framework in a first direction, and the framework is adapted to be displaced on the drilling platform in a second direction running substantially at right angles with the first direction, wherein the drilling mast is adapted to be displaced on the framework in the first direction without a hydraulic and/or preparation unit positioned adjacent to the substructure, and in the second direction jointly with the hydraulic and/or preparation unit, wherein the drilling mast is composed of individual elements, the respective masses of which do not exceed a mass limit value of less than or equal to 25 t. Due to this, it is also possible to variably provide the drilling mast in corner regions of the drilling platform, and a maximum utilization of space is possible.

In accordance with a first aspect there is provided a drilling rig for use on a drilling platform with a drilling mast, characterized in that the drilling mast and/or the energy supply and/or the generating device for hydraulic energy is/are composed of individual elements the respective masses of which do not exceed a mass limit value of less than or equal to 25 t.

The drilling rig according to the first aspect comprises, in accordance with a second aspect, a substructure on which the drilling mast is mounted and which is adapted to be displaced jointly with the drilling mast at least in one direction on the drilling platform.

In the drilling rig according to the first or second aspects, in accordance with a third aspect, the drilling mast is provided with a feed carriage at which preferably a rotary drive is provided and which is adapted to be driven by a hydraulic and/or electrical drive, and which is adapted to be displaced jointly with the substructure and the drilling mast.

In the drilling rig according to any of the first to third aspects, in accordance with a fourth aspect, a hydraulic supply device is adapted to be displaced jointly with the drilling mast.

In the drilling rig according to any of the first to fourth aspects, in accordance with a fifth aspect, a receiving device for drilling rods and/or other drilling equipment is adapted to be displaced jointly with the drilling mast.

In the drilling rig according to any of the first to fifth aspects, in accordance with a sixth aspect, the hook load at the feed carriage is at least 200 short tons, preferably approximately 400 short tons.

In the drilling rig according to any of the second to sixth aspects, in accordance with a seventh aspect, the substructure has a base area of greater than or equal to 6 m×6 m and smaller than or equal to 12 m×12 m.

In the drilling rig according to any of the first to seventh aspects, in accordance with an eighth aspect, a drilling rod handler is provided which is adapted to be displaced jointly with the drilling mast.

A drilling rig according to any of the first to eighth aspects comprises, in accordance with a ninth aspect, stationary with respect to the drilling platform, at least one generator and one electrical device for providing energy.

In the drilling rig according to any of the first to ninth aspects, in accordance with a tenth aspect, the stationary and/or the mobile components of the drilling rig are at least partially, preferably completely, composed of individual elements, the respective masses of which do not exceed the mass limit value indicated.

In the drilling rig according to any of the first to tenth aspects, in accordance with an eleventh aspect, the individual elements are adapted to be joined without welding.

In the drilling rig according to any of the first to eleventh aspects, in accordance with a twelfth aspect, the mass limit value is 22 t, more preferable 17 t or 15 t, and preferably 11 t.

In the drilling rig according to any of the first to twelfth aspects, in accordance with a thirteenth aspect, the drilling mast is adapted to be displaced in a first direction on a framework, and the framework is adapted to be displaced on the drilling platform in a second direction running substantially at right angles with the first direction.

In the drilling rig according to the thirteenth aspect, in accordance with a fourteenth aspect, the drilling mast is adapted to be displaced on the framework in the first direction without the hydraulic supply device and in the second direction jointly with the hydraulic supply device.

In the drilling rig according to the fourteenth aspect, in accordance with a fifteenth aspect, the hydraulic supply device is, with respect to the second direction, adapted to be arranged alternatively at opposite sides of the drilling mast.

In the drilling rig according to any of the second to fifteenth aspects, in accordance with a sixteenth aspect, the substructure has the height of at least two, preferably three standard containers.

In the drilling rig according to any of the first to sixteenth aspects, in accordance with a seventeenth aspect, the drilling platform is an offshore drilling platform.

In the drilling rig according to any of the first to seventeenth aspects, in accordance with an eighteenth aspect, functional elements for controlling, supplying and operating a drilling device and/or the periphery are designed at least partially redundantly.

In the drilling rig according to any of the first to eighteenth aspects, in accordance with a nineteenth aspect, the control device for monitoring the drilling process is designed redundantly.

In accordance with a twentieth aspect, an energy supply device, preferably for a drilling rig, is provided, wherein a combustion engine and the generator are provided in two modules, and wherein the respective masses of the combustion engine and of the generator do not exceed a respective mass limit value of less than or equal to 25 t, preferably 11 t.

In an energy supply device according to the twentieth aspect, in accordance with a twenty first aspect, the generator performance is at least 500 kVA.

In an energy supply device according to the twenty first aspect, in accordance with a twenty second aspect, the modules are adapted to be joined in a gas-tight manner.

In an energy supply device according to any of the twentieth to twenty second aspects, in accordance with a twenty third aspect, a further module is provided in which a heat exchanger and a fuel tank are provided.

In an energy supply device according to any of the twentieth to twenty third aspects, in accordance with a twenty fourth aspect, a further module with a security entrance and a control field is provided.

Flushing pumps are provided in accordance with a twenty fifth aspect, preferably for a drilling rig, for pumping the drilling fluid with at least two, preferably four pumps, the masses of which do not exceed a mass limit value of less than or equal to 25 t, preferably 11 t.

In accordance with a twenty sixth aspect, a device for generating hydraulic energy for a top drive and/or a handler is provided, wherein the individual functional elements forming the device are designed redundantly.

The invention claimed is:

1. A drilling station or drilling rig for use on a drilling platform with a drilling mast, comprising:

a drilling module mounted on guide rails via a framework on which the drilling module is adapted to be displaced in a first direction of the drilling platform, and a hydraulic and/or preparation unit, wherein the drilling module and the hydraulic and/or preparation unit are adapted to be displaced on the guide rails in a second direction running substantially at right angles with the first direction, wherein the drilling module comprises a substructure on the framework on which the drilling mast is mounted, said substructure being adapted to be displaced jointly with the drilling mast on the drilling platform in the first and second directions, and in which a blow out preventer is disposed, and which is arranged next to the hydraulic and/or preparation unit, wherein the hydraulic and/or preparation unit is alternatively arranged at opposite sides of the drilling mast with respect to the first direction, wherein the positions of the drilling module and of the hydraulic and/or preparation unit are exchangeable to service well bores close to hindrances, wherein the drilling mast is adapted to be displaced on the framework in the first direction without the hydraulic and/or preparation unit, and wherein the framework and the drilling mast are adapted to be displaced on the drilling platform in the second direction jointly with the hydraulic and/or preparation unit, wherein the drilling mast, an energy supply, and a generation device for hydraulic energy are composed of individual elements that are joined in a positive-locking or friction-looking manner to the drilling platform, and wherein the drilling mast is composed of individual elements, the respective masses of which do not exceed a mass limit value of less than or equal to 25 t.

2. The drilling rig according to claim 1, wherein an energy supply and/or a generating device for hydraulic energy is/are composed of individual elements, the respective masses of which do not exceed a mass limit value of less than or equal to 25 t.

3. The drilling rig according to claim 1, wherein the drilling mast is provided with a feed carriage at which a rotary drive is provided and which is adapted to be driven by a hydraulic and/or electrical drive, and which is adapted to be displaced jointly with the substructure and the drilling mast.

4. The drilling rig according to claim 1, wherein a hydraulic supply device is adapted to be displaced jointly with the drilling mast.

5. The drilling rig according to claim 1, wherein a receiving device for drilling rods and/or other drilling equipment is adapted to be displaced jointly with the drilling mast.

6. The drilling rig according to claim 1, wherein a hood load at a feed carriage is at least 200 short tons.

7. The drilling rig according to claim 1, wherein the substructure has a base area of greater than or equal to 6 m×6 m and smaller than or equal to 12 m×12 m.

8. The drilling rig according to claim 1, wherein a drilling rod handler is provided which is adapted to be displaced jointly with the drilling mast.

9. The drilling rig according to claim 1, wherein the drilling rig comprises, stationary with respect to the drilling platform, at least one generator and one electrical device for providing energy.

10. The drilling rig according to claim 1, wherein stationary components and/or mobile components of the drilling rig are at least partially composed of individual elements, the respective masses of which do not exceed the mass limit value indicated.

11. The drilling rig according to claim 1, wherein the individual elements are adapted to be joined without welding.

12. The drilling rig according to claim 1, wherein the mass limit value is less than 22 t.

13. The drilling rig according to claim 1, wherein a hydraulic supply device is, with respect to the second direction, adapted to be arranged alternatively at opposite sides of the drilling mast.

14. The drilling rig according to any of claim 1, wherein the substructure has the height of at least two, preferably three standard intermodal containers.

15. The drilling rig according to claim 1, wherein the drilling platform is an offshore drilling platform.

16. The drilling rig according to claim 1, wherein functional elements for controlling, supplying, and operating a drilling device and/or the periphery are designed at least partially redundantly.

17. The drilling rig according to claim 1, wherein a control device for monitoring the drilling process is designed redundantly.

18. The drilling rig according to claim 1, wherein the hydraulic and/or preparation unit is positioned in-line with the drilling mast with respect to the first direction.

19. The drilling rig according to claim 1, wherein the positive-locking or friction-locking manner is without welding or gluing.

* * * * *